US006945527B2

(12) United States Patent
Guddanti et al.

(10) Patent No.: US 6,945,527 B2
(45) Date of Patent: Sep. 20, 2005

(54) HIGH CAPACITY MEDIA APPARATUS AND METHOD

(75) Inventors: Srinivas Guddanti, Ann Arbor, MI (US); Chet M. Butikofer, Meridian, ID (US); Robert Matthew Sesek, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 160 days.

(21) Appl. No.: 10/376,157

(22) Filed: Feb. 28, 2003

(65) Prior Publication Data

US 2004/0169328 A1 Sep. 2, 2004

(51) Int. Cl.[7] ..... B65H 1/08
(52) U.S. Cl. ..... 271/147; 271/160
(58) Field of Search ..... 271/160, 145, 271/162, 147; 221/198, 287, 302

(56) References Cited

U.S. PATENT DOCUMENTS

| | | | | | |
|---|---|---|---|---|---|
| 1,883,008 | A | * | 10/1932 | Sherman | 221/46 |
| 2,118,380 | A | * | 5/1938 | Gresenz | 221/48 |
| 3,367,487 | A | * | 2/1968 | Dwyer, Jr. | 206/449 |
| 3,767,188 | A | * | 10/1973 | Rosenberg et al. | 271/145 |
| 4,274,623 | A | * | 6/1981 | Reist et al. | 271/217 |
| 4,830,354 | A | * | 5/1989 | Penson | 271/147 |
| 5,053,814 | A | * | 10/1991 | Takano et al. | 399/23 |
| 5,126,789 | A | * | 6/1992 | Fukuchi et al. | 399/18 |
| 5,944,306 | A | * | 8/1999 | Maeda et al. | 271/145 |
| 6,286,827 | B1 | * | 9/2001 | Meetze et al. | 271/162 |
| 6,398,210 | B1 | * | 6/2002 | Nomura | 271/145 |

FOREIGN PATENT DOCUMENTS

| | | | |
|---|---|---|---|
| JP | 1-317924 | * | 12/1989 |
| JP | 3-73719 | * | 3/1991 |
| JP | 4-45020 | * | 2/1992 |
| JP | 4-133960 | * | 5/1992 |
| JP | 6-179533 | * | 6/1994 |

* cited by examiner

*Primary Examiner*—Donald P. Walsh
*Assistant Examiner*—Thomas Morrison

(57) ABSTRACT

A high capacity media apparatus and method includes, in a high capacity media device holding large quantities of media, according to one embodiment, a unitary deformable media holder with a bottom, a top, and sides, constructed to separate at preselected locations. A movable support base is provided in the media holder. A lifting device is provided in the high capacity media device and conformed to apply lifting force to the movable support base.

22 Claims, 1 Drawing Sheet

HIGH CAPACITY MEDIA APPARATUS AND METHOD

FIELD OF THE INVENTION

This invention relates to a high capacity media apparatus and method. In particular, according to one embodiment, the invention relates to a high capacity media apparatus and method in a high capacity media device holding large quantities of media. A unitary deformable media holder includes a moveable support base and access ports that provide access to a lifting device in the high capacity media device that is conformed to align with the access ports for applying lifting force to the movable support base.

BACKGROUND OF THE INVENTION

The paperless office remains the optimistic hope of many. Nonetheless, despite the ongoing electronic revolution, more paper is being used in offices around the country and throughout the world than ever before. In fact, the increased demand for high capacity media devices, such as high speed copiers and printers capable of holding multiple reams of media, for example only and not by limitation, for the creation and reproduction of documents, pictures, and the like has created a new office drudgery that is time-consuming, and therefore costly, and subject to failure. This thankless task is the job of properly loading these high capacity media devices with multiple reams of media, such as standard letter size and A4 paper used for most office printing and copying.

Typically, high capacity media devices are capable of holding four or more reams of paper. As a result, today when a high capacity input (HCI) device runs out of paper, the user must open a box containing reams of paper. Then, the user must open and load four or more reams, as appropriate, before most high-end HCIs are fully loaded. In addition to the box and/or packaging the reams come in as a group, each ream is individually wrapped. Another negative aspect of the current process is the large amounts of waste wrappers and packaging materials that are generated.

Loading and waste generation are not the only problems encountered in the prior art use of HCI devices. Another problem is that if the reams of paper are not properly aligned, the misalignment often causes paper jams and malfunctions. A related issue is "splits". Splits occur at the interface of one ream of paper with another. Even the most careful alignment does not always ensure that a jam or malfunction will not occur at a split. Still further, prior art HCI devices using large amounts of media are adversely affected by moisture. Moisture affects the ability of the HCI devices to pick up media for processing.

SUMMARY OF THE INVENTION

The high capacity media apparatus and method according to the present invention includes, in a high capacity media device holding large quantities of media, a unitary deformable media holder with a bottom, a top, and sides, with the media holder constructed to separate at preselected locations. A movable support base is provided in the media holder. A lifting device is provided in the high capacity media device and is conformed to apply lifting force to the movable support base.

DETAILED DESCRIPTION OF THE INVENTION

Figure 1:
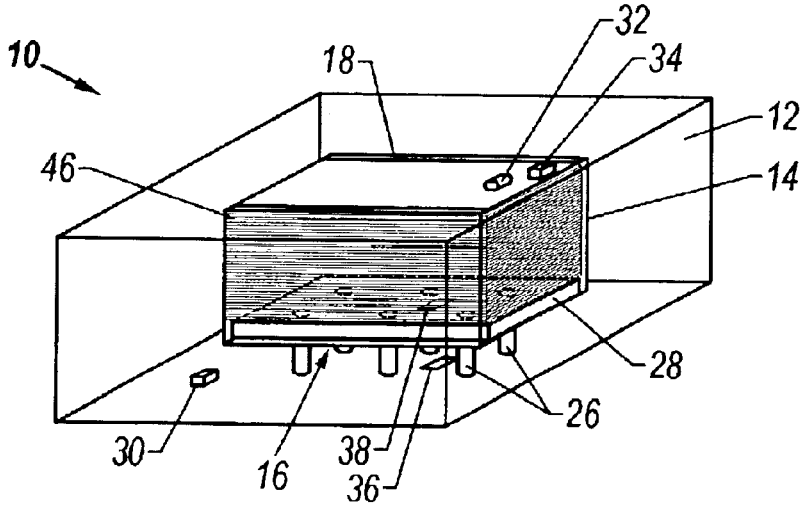
FIG. 1 is a perspective see-through view of the high capacity media apparatus according to an embodiment of the present invention.
Figure 2:
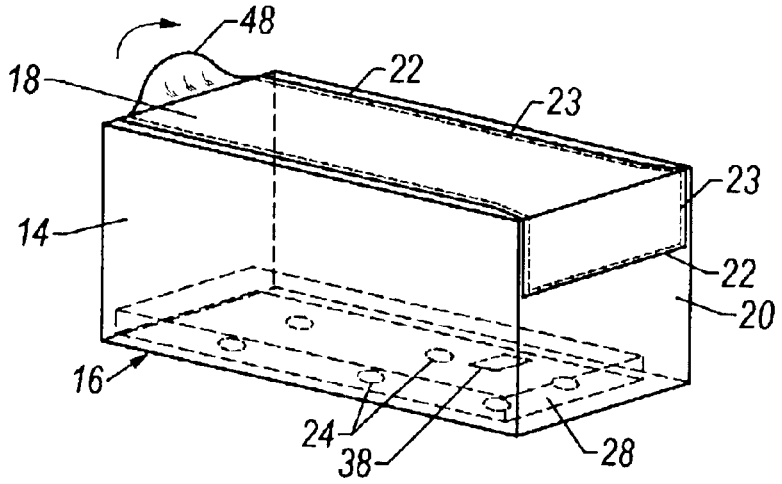
FIG. 2 is a perspective see-through view of the embodiment of FIG. 1.

An embodiment of the present invention is illustrated by way of example in FIGS. 1–4. With specific reference to FIGS. 1 and 2, the high capacity media apparatus 10 according to an embodiment of the present invention includes a high capacity media device 12. High capacity media device 12, may be a printer, a copier, or any other device now known or hereafter developed, capable of storing multiple reams of media. A unitary deformable media holder 14, such as a box, includes a bottom 16, a top 18 and sides 20. Media holder 14, and preferably top 18, is constructed so as to separate at pre-selected locations 22 as by means of perforations 23. Unitary deformable media holder 14 also includes access ports 24, such as holes or slots, in the bottom 16. High capacity media device 12 includes a lifting device 26 that aligns with the access ports 24 to apply lifting force to movable support base 28 within unitary deformable media holder 14.

According to another embodiment, a media holder sensor 30 is connected to the high capacity media device 12 so as to signal/sense the presence of the media holder 14 when it is placed within high capacity media device 12. In this embodiment, media holder sensor 30, upon sensing the presence of media holder 14, signals high capacity media device to release lifting device(s) 26 thereby allowing lifting devices 26 to apply lifting pressure against the bottom of movable support base 28 through access ports 24 in media holder 14.

According to another embodiment, lifting device 26 is engaged when a loading door (not shown) of high capacity media device 12 is closed. If no media 46 is present, the media lifting mechanism 26 moves to the top of the high capacity input device 12 until the lifting pins 42 are detected by a sensor 32 located at the top of the high capacity media device 12. If the pins 42 are detected and no media 46 is detected, an unloaded or paper out state is indicated. In this case pins 42 retract and a new full media holder 14 is placed within device 12. At that point, sensor 30, detecting the presence of media holder 14, signals the release of lifting device 26 and pins 42 extend to apply lifting force to the movable support base 28 as shown in FIG. 1.

According to another aspect of the invention, media sensor 32, such as a mechanical or an optical sensor, for example only and not by limitation, or any other sensors now known or hereafter developed, is connected to high capacity media device 12 so as to signal/sense the presence of media 46 next to the pick roller assembly 34 of high capacity media device 12. In another aspect of the invention, a label sensor 36, such as a bar code scanner or an RFID sensor receiver, is connected to high capacity media device 12 so as to signal/sense and read a label 38 attached to the bottom 16 of media holder 14. Label 38 may be any machine readable label now known or hereafter developed such as a bar code label. Label 38 may include paper size, quantity, weight, texture, surface roughness or any other feature or information now known or hereafter developed. In combination, label sensor 36 and label 38 identify the media type to the high capacity media device 12. In one aspect of the invention, high capacity media device 12 is conformed to adjust the fuser temperature, print speeds or other processing parameters as appropriate for the characteristics of the identified media type. Media holder sensor 30, media sensor 32 and label sensor 36 may be combined into a single sensor and may be any type of sensor now known or hereafter developed. Connection of the sensors 30, 32, and 36 to high capacity media device 12 and the use of the sensor information to operate and adjust high capacity media device 12 is not disclosed specifically as it is well within the ordinary skill of those in the art.

Figure 3:
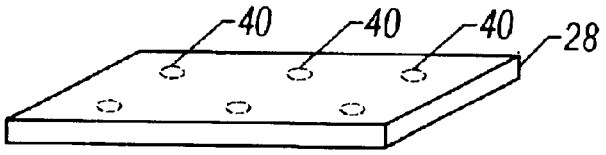
FIG. 3 is a perspective view of the movable support base with indents of the embodiment of FIG. 1.

Referring now to FIG. 3, movable support base 28 is illustrated including indents 40. Indents 40 serve the purpose and function of receiving and retaining lifting devices 26 and preventing them from moving horizontally during the vertical lifting process. Indents 40 also serve the purpose of aligning media holder 14 within device 12. When in the proper position, pins 42 are released and effectively hold the base 28 and media holder 14 in proper alignment within device 12. According to an embodiment, a plurality of indents 40 are provided to correspond to the plurality of access ports 24 in the bottom 16 of unitary deformable media holder 14. In one aspect of the invention, six access ports 24 correspond to six indents 40.

Figure 4:
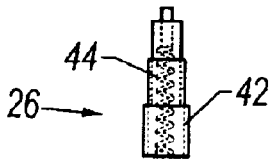
FIG. 4 is a side see-through view of the telescoping pressure sensitive lifting pin of the embodiment of FIG. 1.

Referring now to FIG. 4, in one aspect of the invention, lifting device 26 takes the form of telescoping, pressure sensitive pins 42. Pins 42, again, provide the lifting force to the movable support base 28. According to one embodiment, pins 42 are pressure sensitive in the sense that they provide upward pressure by means of collapsible spring 44. Certainly, the upward pressure may be provided by any electrical, mechanical, or hydraulic device now known or hereafter developed. That is to say, for example only, telescoping pins 42 may be replaced by a pulley system connected to the base 28 and the top of device 12 such that the base 28, and media 46, is pulled up from the top of the device 12 along vertical slots in the side 20 of media holder 14. In any event, according to one aspect of the invention, pins 42 are in a collapsed position prior to the insertion of the media holder 14 into high capacity media device 12. Once media holder 14 is placed within high capacity media device 12, pins 42 are released. It does not matter whether the media device is a top loading or a side loading device 12. Pins 42 may be released manually, or, in one aspect of the invention by means of media holder sensor 30, as discussed above. It may be that no release mechanism is needed. In the case of a top loading device 12, for example only and not by limitation, the pins 42 may be extended in the unloaded position and the act of placing the media holder on top of the pins 42, collapses the pins 42 and "loads" the springs 44 within them so that pins 42 apply upward pressure on the base 28. In any event, the release mechanism is not disclosed specifically herein. It may be any type, electrical, mechanical, or the like, and is well within the capabilities of those of ordinary skill in the art. Lifting device 26 and sensors 30,32 and 36 may be factory installed in new high capacity media devices 12 or retrofitted as the case may be.

In one aspect of the invention, unitary deformable media holder 14 is constructed so as to absorb moisture. This could be accomplished by including a desiccant in the box or by other means now known or hereafter developed. In another aspect of the invention, unitary deformable media holder 14 is constructed of cardboard. Cardboard absorbs moisture and keeps the preloaded media 46 ready to use. In another aspect of the invention, the sides 20 of unitary deformable media holder 14 are constructed so as to provide vertical alignment for media 46, such as paper, contained within media holder 14. This aspect of the invention is directed to assisting in the proper alignment of the media holder 14 within the device 12 and also to ensuring that the media 46 is presented to the pick roller 34, or any other media picking mechanism, in a proper, useful fashion.

Referring again to FIG. 2, in an embodiment, unitary deformable media holder 14 has a top 18 with a handle 48. Unitary deformable media holder 14 is first filled with the equivalent of at least more than one standard ream of media, where a standard ream is a ream that holds five hundred sheets of media. As used herein, the term "ream" includes any segregated, individually distributed collection of media. Reams may include more or less than five hundred sheets and high capacity media devices 12 still hold "multiple reams" of media 46. Again, high capacity media devices 12 typically hold four or more reams of paper/media 46. This feature of the invention ensures that there are no splits in a fully loaded holder 14 since all the media 46 is loaded continuously at one time. A full media holder 14 is brought to high capacity media device 12 and handle 48 is pulled. Because of perforations 23 at preselected locations 22 of media holder 14, pulling on handle 48 removes a preselected portion of media holder 14. According to one embodiment, the top 18 and some part of a side 20 is removed thereby exposing media 46 to pick roller assembly 34. As clearly illustrated in FIG. 2, once the preselected portion of media holder 14 is removed the entire surface of media 46 is fully exposed such that no matter what type of pick roller assembly is used, media 46 is fully accessible. Predetermined locations 22 may be defined by perforations 23 or by any type of releasable, removable configuration now known or hereafter developed. For example only and not by limitation, perforations 23 may be replaced with tape, glue, string pull tabs or any other system for selectively removing a predetermined portion of media holder 14. According to one embodiment, this top handle portion 48 is the only waste generated in the process of fully loading high capacity media device 12 as opposed to the very much larger amount of waste products generated in prior art systems as previously described. At that point, all a user has to do to fully load high capacity media device 12 is to place media holder 14 within high capacity media device 12, a process that takes a mere fraction of time to complete in comparison to today's standard. This automatically aligns the access ports 24 in the bottom 16 with the lifting device 26 such that media 46 is forced into contact with pick mechanism 34 and device 12 is ready to print/copy. Additionally, as used herein the term "unitary deformable media holder" is meant to include a media holder 14 with a removable top 18 not joined physically but held in place by some other means such as removable ties, such as, for example only and not by limitation, plastic straps. In such a case, once the straps are removed, access to the media holder 14 is provided by simply lifting the top 18 off of the media holder 14.

The description of the present embodiments of the invention has been presented for purposes of illustration, but is not intended to be exhaustive or to limit the invention to the form disclosed. Many modifications and variations will be apparent to those of ordinary skill in the art. For example only and not by limitation, media holder 14 may be a throw away item or it may be built of material, plastic or the like, which enables it to be reused. In much the same way that printer cartridges are sent back to be factory filled, media holder 14 may be sent back to be factory filled with another load of media 46. As such, while the present invention has been disclosed in connection with an embodiment thereof, it should be understood that other embodiments may fall within the spirit and scope of the invention as defined by the following claims.

What is claimed is:

1. In a high capacity media device holding large quantities of media, a high capacity media apparatus, the apparatus comprising:

a) a unitary deformable media holder with a bottom and without a separate top, with the unitary deformable media holder constructed to separate preselected locations so as to remove a portion of more than one side of said unitary deformable media holder and expose the entire surface of the media;

b) movable support base inside said unitary deformable media holder;

c) at least one access port in said bottom; and d) lifting means in said high capacity media device conformed to align with said at least one access port for applying lifting force to said moveable support base wherein said lifting means is a telescoping pressure sensitive pin.

2. The apparatus of claim 1 further comprising a media sensor connected to said high capacity media device conformed to sense the presence of media in said unitary deformable media holder.

3. The apparatus of claim 1 further comprising a label sensor connected to said high capacity media device for detecting and reading a label attached to said unitary deformable media holder.

4. The apparatus of claim 3 wherein said label is attached to the outside of said bottom of said unitary deformable media holder.

5. The apparatus of claim 4 wherein said label is attached next to said at least one access port.

6. The apparatus of claim 1 wherein said moveable support base includes indents conformed to receive and retain said lifting means.

7. The apparatus of claim 1 wherein said unitary deformable media holder is conformed to absorb moisture.

8. The apparatus of claim 1 wherein said unitary deformable media holder is made of cardboard.

9. The apparatus of claim 1 further including a pull device for removing a portion of more than one side of said unitary deformable media holder.

10. The apparatus of claim 1 wherein said bottom includes six access ports.

11. The apparatus of claim 3 wherein said label identifies the media type to said high capacity media device and said high capacity media device is conformed to adjust device settings to fit the identified media type.

12. The apparatus of claim 1 wherein sides of said unitary deformable media holder are conformed to provide vertical alignment of said media.

13. In a high capacity media device holding multiple reams of media, a high capacity media apparatus, the apparatus comprising:

a) a unitary deformable media holder conformed to absorb moisture with a bottom and sides, and without a separate top, the unitary deformable media holder constructed to separate at preselected locations so as to remove a portion of more than one side of said unitary deformable media holder and expose the entire surface of the media;

b) a moveable support base inside the unitary deformable media holder, the support base conformed to include a plurality of indents;

c) a plurality of access ports in the bottom conformed to cooperate with the plurality of indents;

d) a plurality of lifting devices in the high capacity media device conformed to cooperate with the plurality of access ports and plurality of indents so as to apply lifting pressure to the moveable support base wherein said plurality of lifting devices are telescoping pressure sensitive pins; and e) at least one sensor connected to the high capacity media device.

14. The apparatus of claim 13 wherein a label is attached to the outside or the bottom of the unitary deformable media holder between the access ports.

15. The apparatus of claim 13 wherein said plurality of access ports includes six access ports.

16. The apparatus of claim 13 further including a pull handle connected to the top of the media holder and conformed to remove the top and at least a portion of one side of the media holder.

17. The apparatus of claim 14 wherein the label identifies the media type to the high capacity media device and the high capacity media device is conformed to adjust settings to fit the identified media type.

18. The apparatus of claim 13 wherein the unitary deformable media holder is cardboard.

19. The apparatus of claim 13 wherein the sides are conformed to provide vertical alignment of the media.

20. In a high capacity media device holding multiple reams of media, a high capacity media method, the method comprising the steps of:

a) providing a unitary deformable media holder, with media inside, without a separate top, a bottom, and sides, conforming the unitary deformable media holder to absorb moisture and constructing the unitary deformable media holder to separate at preselected locations so as to remove a portion of more than one side of said unitary deform able media holder and expose the entire surface of the media;

b) providing a moveable support base inside the unitary deformable media holder and conforming the support base to include a plurality of indents;

c) constructing a plurality of access ports in the bottom so as to cooperate with the plurality of indents in the moveable support base;

d) connecting a plurality of lifting pins in the high capacity media device so as to cooperate with the plurality of access ports and to apply lifting pressure to the moveable support base wherein said plurality of lifting pins are telescoping pressure sensitive pins;

e) connecting a media holder sensor, a media sensor and a label sensor to the high capacity media device;

f) removing at least a portion of more than one side at the preselected locations of the unitary deformable media holder; and g) inserting the unitary deformable media holder into the high capacity media device such that the access ports align with the lifting pins and the lifting pins apply lifting force to the moveable support base.

21. The method of claim 20 further comprising the steps of:

a) attaching a label to the outside of the bottom of the unitary deformable media holder between the access ports;

b) conforming the label to identify characteristics of the media to the media sensor; and c) conforming the high capacity media device to automatically adjust to fit the identified media characteristics.

22. A high capacity media apparatus comprising:

a) a unitary deformable media holder means for holding more than one ream of media;

b) a moisture absorbing means for absorbing moisture integral to the unitary deformable media holder means;

c) a moveable support base means for supporting media connected to the unitary deformable media holder means;

d) at least one access port means for accessing the moveable support means;

e) at least one lifting means connected to the at least one access port means for lifting the moveable support base means wherein said at least one lifting means is a telescoping pressure sensitive pin; and f) a preselected removable section means of the unitary deformable media holder means for removing a portion of more than one side of said unitary deformable media holder means and exposing the entire surface of the media.

* * * * *